US007703980B2

(12) United States Patent
Sampaio Camacho

(10) Patent No.: US 7,703,980 B2
(45) Date of Patent: Apr. 27, 2010

(54) RESEALABLE FLEXIBLE PACKAGING

(75) Inventor: José Manuel Sampaio Camacho, Parede (PT)

(73) Assignee: Amcor Flexibles France, Saint Hilaire (FR)

( * ) Notice: Subject to any disclaimer, the term of this patent is extended or adjusted under 35 U.S.C. 154(b) by 1009 days.

(21) Appl. No.: 10/533,961

(22) PCT Filed: Oct. 18, 2002

(86) PCT No.: PCT/FR02/03582

§ 371 (c)(1),
(2), (4) Date: Mar. 23, 2006

(87) PCT Pub. No.: WO2004/037664

PCT Pub. Date: May 6, 2004

(65) Prior Publication Data

US 2006/0251341 A1 Nov. 9, 2006

(51) Int. Cl.
*B65D 33/16* (2006.01)
*B65D 33/30* (2006.01)

(52) U.S. Cl. ..... 383/62; 383/77; 383/89; 383/90; 383/203

(58) Field of Classification Search ..... 383/62, 383/77, 85, 88–90, 120, 203, 204
See application file for complete search history.

(56) References Cited

U.S. PATENT DOCUMENTS 1,133,911 A * 3/1915 Barnard ..... 383/62
1,619,887 A * 3/1927 Sapp ..... 383/62
2,234,065 A * 3/1941 Vogt ..... 383/120
3,107,842 A 10/1963 Guilfoyle
3,214,080 A * 10/1965 Wolfson ..... 383/11
3,249,288 A * 5/1966 Repko ..... 383/204
3,389,783 A * 6/1968 Bjorkengren ..... 426/107
3,806,024 A * 4/1974 Marchesani ..... 383/62
4,428,477 A * 1/1984 Cristofolo ..... 206/210
4,826,011 A * 5/1989 Jud ..... 383/88
5,078,509 A 1/1992 Center et al.
5,407,419 A 4/1995 Kelly et al.
5,459,978 A * 10/1995 Weiss et al. ..... 53/425
5,888,648 A * 3/1999 Donovan et al. ..... 428/349
5,928,749 A * 7/1999 Forman ..... 428/43
6,517,243 B2 * 2/2003 Huffer et al. ..... 383/88
6,929,400 B2 * 8/2005 Razeti et al. ..... 383/66
7,416,768 B2 * 8/2008 Knoerzer et al. ..... 428/40.1
2004/0008908 A1 * 1/2004 Shepard ..... 383/89

* cited by examiner

*Primary Examiner*—Jes F Pascua
(74) *Attorney, Agent, or Firm*—Sughrue Mion, PLLC

(57) ABSTRACT

A flexible envelope having a body initially scaled at one end in a zone designed to be opened, the body including at least two walls (26A, 26B) whereof the longitudinal edges are bound together along a longitudinal weld (14) extending over the height of the body, at least one of the walls (26A, 26B) extending outside the body beyond the longitudinal weld (14) to form a flap (36). The package has a weakened line (42) constituting an incipient tear formed on the flap (36) along the longitudinal weld (14), the weakened line (42) delimiting on the flap (36) a strip (43A) at least locally detachable from the package body and an adhesive (44) borne by a strip (43A), the adhesive (44) being designed to enable the strip to be subsequently bonded against the package outer surface.

9 Claims, 3 Drawing Sheets

RESEALABLE FLEXIBLE PACKAGING

CROSS-REFERENCES TO RELATED APPLICATIONS

This application is a 371 of PCT/FR02/003582, filed on Oct. 18, 2002.

BACKGROUND OF THE INVENTION

The present invention relates to a flexible packaging, of the type comprising a body initially closed at one end in a region designed to be open, the body comprising at least two sections whose longitudinal edges are bonded to each other along a longitudinal weld lying along the height of the body, at least one of the sections extending outside the body beyond the longitudinal weld for a flap.

Many food products, such as pulverulent products like coffee and flour, liquid products, or granular products such as pastas and rice, are packaged in flexible packages of the aforementioned type. These packages are formed from one or more welded sheets. They generally have at least one lower transverse weld made in the base of the body and an upper transverse weld initially made in the upper end of the body. To take out the products contained in the packaging, the upper weld is completely or partially broken or else the upper end of the packaging is completely or partially detached. The open packaging forms a pouch, access to which is possible from the upper end which forms a neck defining a passage for access inside the pouch.

After removing the upper transverse weld, it is difficult to keep the neck closed in order to prevent leakage of the products which are still contained in the pouch.

In order to keep such packages closed, it has been proposed to provide an adhesive strip attached to the body, one end of which is sealed permanently to the outer face of the packaging body and the other end of which is adapted in order to be stuck to the opposite face of the packaging body after the neck has been folded over itself, thus keeping the neck compressed between the packaging body.

Metal strips attached to the end of the neck are also known, these metal strips comprising, on each side, plastically deformable extensions making it possible, after the neck has been rolled over itself, to fold down the extensions of the strip on each side of the neck so as to keep the latter in its rolled position.

The means of retaining the rolled part of the neck in order to allow reliable resealing of the packaging are relatively expensive to implement since they require fastening external elements to the packaging.

SUMMARY OF THE INVENTION

The aim of the invention is to provide a flexible packaging which can easily be resealed and whose manufacturing cost is small.

To this end, the subject of the invention is a flexible packaging comprising a body initially closed at one end in a region intended to be open, the body comprising at least one main face formed from two sections whose longitudinal edges are bonded to each other along a longitudinal weld lying along the height of the body substantially in the central part of the main face, at least one of the sections extending outside the body beyond the longitudinal weld in order to form a flap, characterized in that it comprises a line of weakness which favors tearing and which is formed on the flap along the longitudinal weld, the said line of weakness defining, on the flap, at least one strip which can be detached at least locally from the body of the packaging and an adhesive borne by a strip, which adhesive is suitable for providing subsequent sticking of the strip against the outer surface of the packaging.

According to particular embodiments of the invention, the packaging comprises one or more of the following features:

- the flap comprises, in the region bearing the adhesive, superimposed-extensions of the two sections;
- the flap comprises, in the region bearing the adhesive, only one of the extensions of the two sections;
- the longitudinal weld is of the outer face against inner face type;
- the longitudinal weld is of the inner face against inner face type;
- the adhesive is placed along one face of a strip turned toward the body of the packaging;
- the adhesive is a pressure-sensitive adhesive, which adhesive is initially inserted between a strip and the outer surface of one of the packaging sections, the adhesion force of the adhesive to the surface of the strip being greater than the adhesion force of the adhesive to the outer surface of the section;
- it comprises a detachable protective film initially covering the adhesive borne by the strip; and
- the adhesive is an adhesive chosen from the group consisting of a hotmelt, a cold-setting adhesive, a double-sided adhesive tape and an adhesive bead.

BRIEF DESCRIPTION OF THE DRAWINGS

The invention will be better understood on reading the following description, given solely by way of example and made with reference to the drawings in which.

DETAILED DESCRIPTION OF THE DRAWINGS

Figure 1:
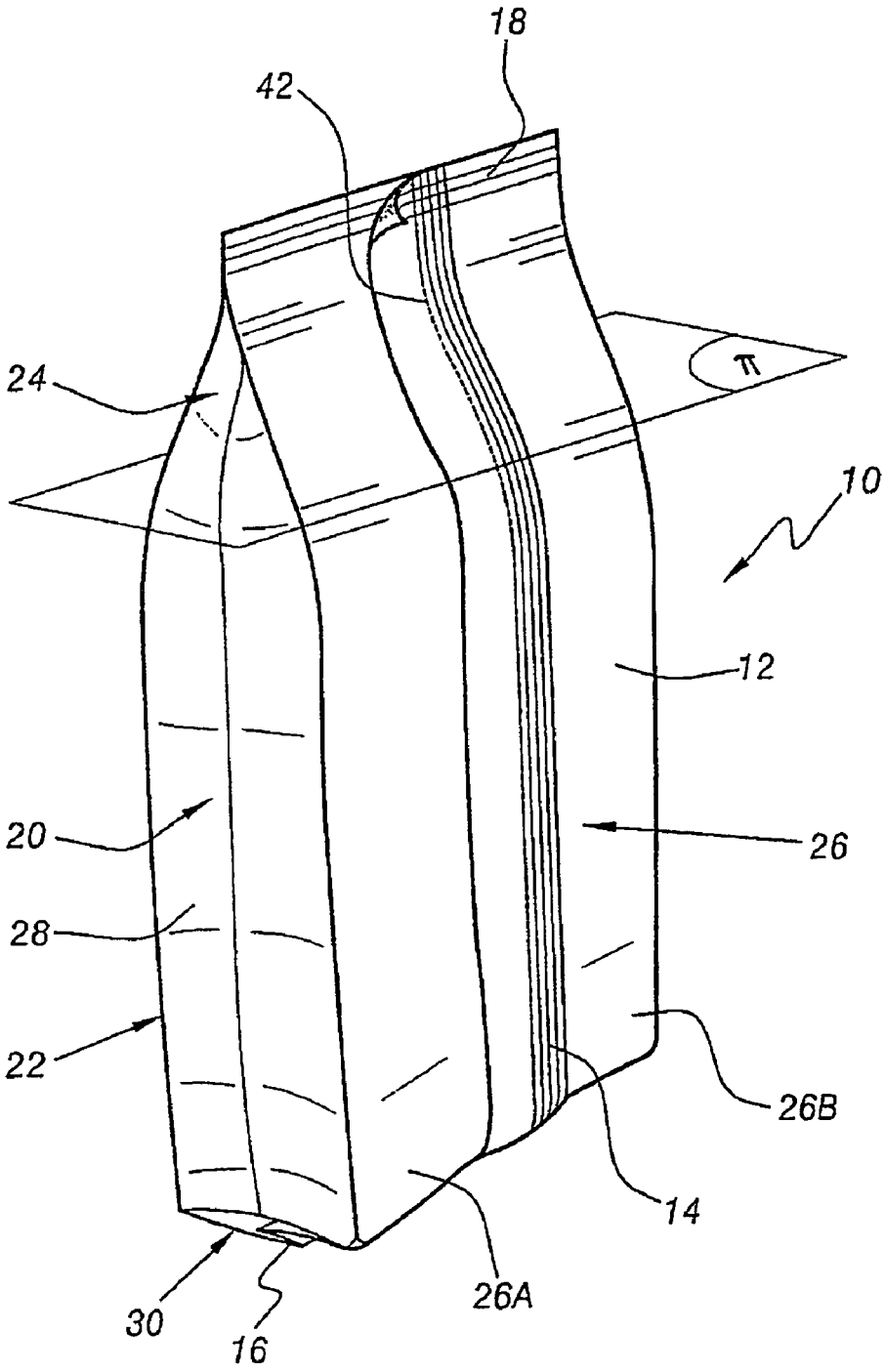
FIG. 1 is a perspective view of a packaging according to the invention, before opening.

The flexible packaging 10 shown in FIG. 1 is intended, for example, for packaging powder coffee, or any other pulverulent or granular product, which may or may not be a food product.

It is formed from a single flexible sheet 12 folded over itself longitudinally and fastened along a longitudinal weld 14. The packaging is closed at its lower end by a transverse weld 16 and at its upper end by a transverse weld 18.

More specifically, in the embodiment shown, the flexible packaging 10 forms a pouch 20 designed to be open at its upper end. The pouch 20 comprises a body 22 forming the vertical portion of the pouch, this portion being designed to contain the packaged products. The body 22 extends toward the upper end of the body by means of a neck 24 which is generally free of product.

The pouch 20 has two opposed main faces 26 extending parallel to each other and two side faces 28 connecting the main faces 26 and lying parallel to each other.

The longitudinal weld 14 defines, on one of the main faces of the pouch, two adjacent sections 26A, 26B. These two sections are connected to each other along the height of the packaging, by the longitudinal weld 14. The longitudinal weld lies in the central part of the main face 26, separating the latter into two substantially symmetrical sections 26A, 26B.

At the lower end, the body is closed off by a bottom 30 obtained by folding the sheet. The lower transverse weld 16 is applied against the bottom 30.

The side faces 28 have, at their upper end along the length of the neck 24, an inner fold forming a bellows making it possible for the two main faces 26 to come together in the region of the upper transverse weld 18.

According to the invention, the packaging incorporates means making it possible to retain a rolled-up part of the neck of the initially opened packaging so as to allow reliable resealing of the latter.

The longitudinal weld 14 is of the inner face against inner face type, that is to say that it is made by placing the surfaces of the sheet defining the inside of the packaging against each other.

The longitudinal weld 14 is made away from the two longitudinal edges of the sheet. Thus, a flap 36 hinged at the weld 14 is defined between the weld 14 and the longitudinal edges of the sheet, this flap initially being held against the section 26A. In the embodiment envisioned, the flap 36 is formed by the two extensions 38A, 38B of the sections 26A and 26B, beyond the weld 14.

Furthermore, a line of weakness 42 is made in the flap 36 over the entire length of the packaging along the weld 14. This line of weakness defines two superimposed extension strips 43A and 43B in the flap. This line of weakness 42 promotes tearing of the sheet forming the packaging along the weld 14. It consists, for example, of a prescoring line formed from an alignment of notches which may or may not be open.

Finally, a pressure-sensitive adhesive is placed on one of the extension strips 38 and 40, on the face of this strip turned toward the packaging.

More specifically, in the embodiment envisioned, an adhesive 44 is placed over the entire central part of the surface of the strip 43A extending the section 26A, the adhesive 44 thus being inserted between the surfaces facing the section 26A and the strip 43A. Thus, marginal areas free from adhesive are placed along the edge of the strip 43A and along the line of weakness 42.

The adhesive 44 and the surfaces facing the section 26A and the strip 43A are adapted so that the adhesion of the adhesive 44 to the strip 43A is greater than the adhesion of the adhesive 44 to the section 26A.

The adhesive 44 consists, for example, of a cold-setting adhesive, or of a hotmelt. The adhesive is applied by zones when using a hotmelt or by coating for a solvent-based hotmelt coating. As a variant, the adhesive consists of a double-sided adhesive tape, a double-sided adhesive bead or a repositionable adhesive coating.

To manufacture such a packaging, a packaging sheet still incorporated with a strip from a coil is adhesively coated using the adhesive 44 on one of its edges over a width less than the width of the strip 43A. The strip is then put in place around a tubular shaper having a generally rectangular cross section. The sheet rolled in this way around the tubular shaper has its two longitudinal edges brought together, and applied to each other along the face of the sheet turned toward the shaper. The longitudinal weld 14 is then made by clamping the longitudinal edges between two heated jaws. The weld is made at some distance from the longitudinal edges so as to leave the extensions 38A and 38B free of any weld. When placing the strip around the shaper, the adhesive 44, initially borne by the edge of the strip, is applied to the outer surface of the body in the region intended to form the section 26A.

Before producing the longitudinal weld 14, the line of weakness 42 is formed in the extensions 38A, 38B by means of a suitable tool, such as a wheel with cutting teeth, or else a prescoring laser beam. The line of weakness is made on the strip still in the form of a coil. This line may be continuous or discontinuous.

If the sheet forming the packaging is multilayer, the line of weakness 42 may be formed only in the outer layers of the sheet.

The packaging is manufactured as known per se by simultaneous production of upper and lower transverse welds of two consecutive packages and by separating these two packages.

Figure 5:
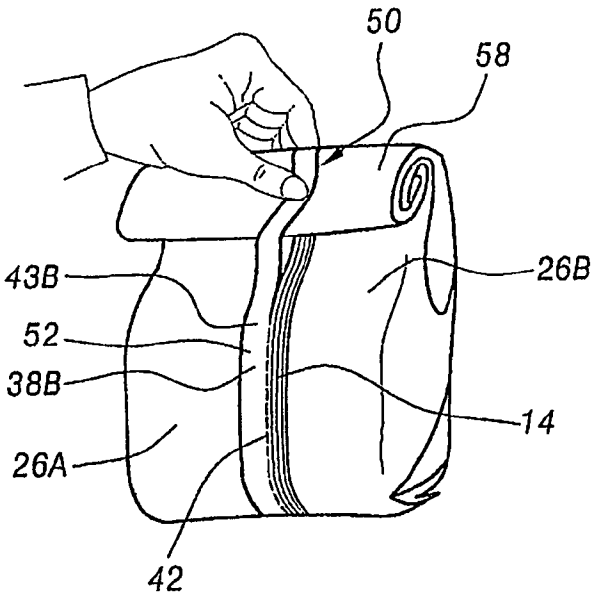
FIGS. 3, 4 and 5 are views similar to that of FIG. 1 illustrating the successive stages of resealing the packaging.
Figure 4:
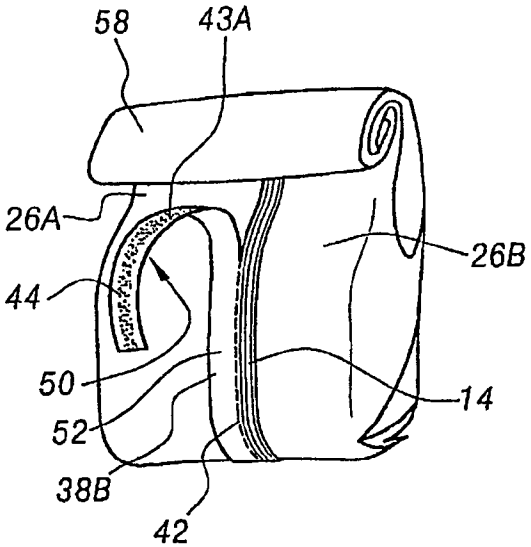
Figure 3:
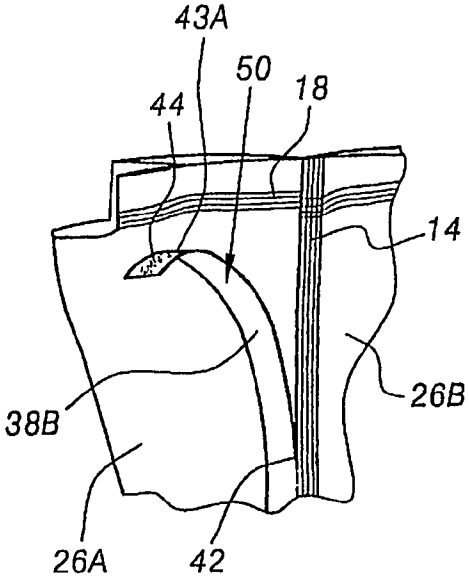

The packaging is used as illustrated in FIGS. 3 to 5.

In FIG. 3, the packaging is shown partially, while a corner of the upper end of the neck 24 has been cut so that the upper transverse weld 18 is partially broken, thus allowing access into the pouch.

The first stage of resealing the packaging consists in moving the upper part of the strip 43A away from the section 26A and in partially separating the strip 43A from the rest of the packaging, by breaking the line of weakness 42 from its upper end.

To do this, the user grasps the upper end of the strip 43A and pulls the latter toward the bottom of the packaging.

Because of the difference of adhesion of the adhesive 44 on the surface of the strip 43A and on the section 26A, the adhesive is taken with the strip 43A, covering most of the exposed surface thereof.

The detached part of the strip, at least over most of the length of the neck 24, consists of a tab 50 still fastened to the lower part of the packaging body. The base 52 of the strip, forming the part still bonded to the packaging body, is located substantially in the end region for filling the packaging.

To reseal the packaging, and as illustrated in FIG. 4, the neck 24 is folded over itself several times in order to form a roll 58. This roll is formed along the main face 26 of the packaging having the weld 14. When folding the neck, the adhesive-coated tab 50 is held away from the roll 58.

As illustrated in FIG. 5, after the neck 24 of the packaging is folded in order to form the roll 58 down to the part of the packaging still containing articles, the adhesive-coated tab 50 is folded down transversely above and around the roll 58, the free end of the tab 50 being stuck to the main face of the packaging opposite the main face bearing the weld 14.

It is understood that the roll 58 is kept rolled up by the action of the tab 50 stuck, on the one hand, around the roll and secured, at each of its ends, to the main faces of the packaging.

In this position, the packaging is reliably resealed.

As a variant, the line of weakness 42 does not lie over the entire height of the packaging. It is limited to the upper part of the packaging in the neck region.

FIGS. 6 to 9 show variant embodiments of a packaging according to the invention.

In these various embodiments, the parts identical or similar to those of the first embodiment are denoted by the same reference numbers.

Figure 2:
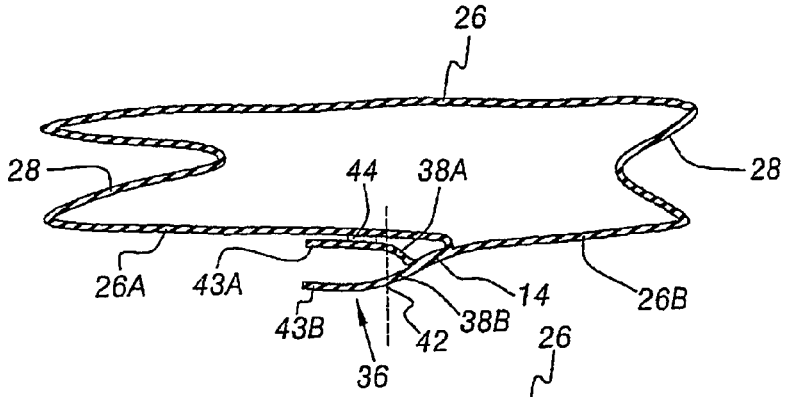
FIG. 2 is a cross-sectional view of the packaging of FIG. 1, taken along the plane $\pi$.
Figure 6:
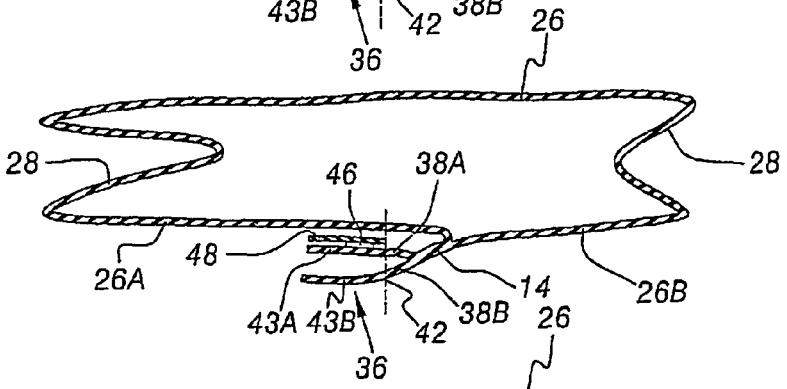
FIGS. 6 to 9 are views identical to that of FIG. 1 for variant embodiments of the packaging according to the invention.

The embodiment of FIG. 6 differs from that of FIG. 2 only in that the adhesive 44 is replaced by the combination of an adhesive layer 46, initially covered by a detachable protective film 48.

It is understood that, in this embodiment, the flap 36 is left independent of the section 26A against which it is however pressed.

To close the packaging, after initial opening, and as in the previous embodiment, the strips 43A and 43B are detached from the packaging body at their upper end where the packaging is open. This partial detachment takes place by breaking the line of weakness 42. However, the strips 43A and 43B remain fastened to the packaging body in the lower part thereof.

After rolling the packaging neck, the protective film 48 is partially or completely removed from the upper end of the strip 43A, thus exposing the adhesive 46. The strip 43A adhesively coated in this way is then attached to and around the roll in order to keep the latter in place.

Figure 7:
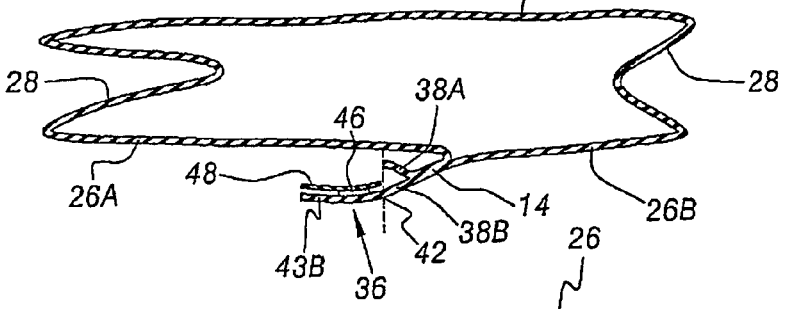

In the embodiment of FIG. 7, the strip 43A does not exist during manufacture of the packaging, the extension 38A being chosen to be very short. The surface of the strip 43B turned toward the section 26A is partially covered with adhesive 46. This adhesive consists of a double-sided adhesive tape initially protected by a detachable film 48.

In this embodiment, the adhesive 46 is applied to the surface of the sheet 12 defining the inside of the packaging and not to the outer surface, as in the previous embodiments.

The packaging is resealed as above by partial cutting of the upper end of the strip 43A and by removing the protective film 48, the adhesive-coated part of the strip 43B being folded down on the rolled neck of the packaging.

Figure 8:
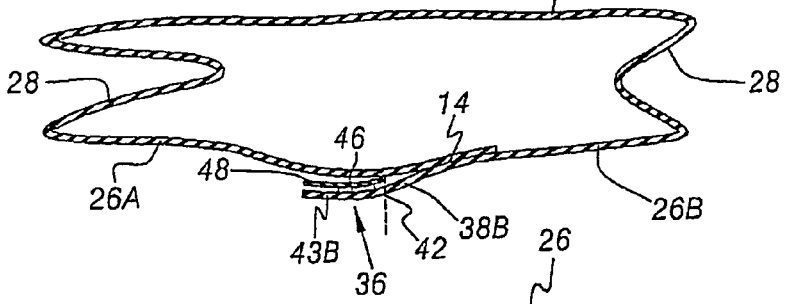
Figure 9:
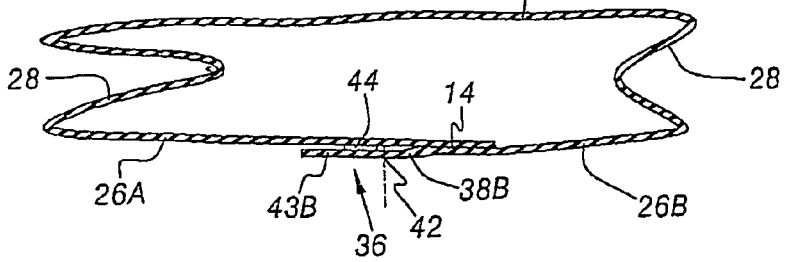

FIGS. 8 and 9 show packages formed from a single sheet whose longitudinal weld 14 is of the inner face against outer face type, that is to say that it is made by placing the opposite surfaces of the sheet defining the packaging against each other.

Thus, only one of the sections 26B of a main face of the packaging extends outside the packaging. The flap 36 then consists of a single extension 38B. As in the previous embodiments, a line of weakness 42 is made in this extension, along the longitudinal weld 14, so as to define a strip 43B. In the embodiment of FIG. 8, this strip bears, on its surface turned toward the packaging body and especially the section 26A, an adhesive 46 initially covered with a protective film 48.

On the other hand, in the embodiment of FIG. 9, adhesive 44 is placed between the facing surfaces of the strip 43B and of the section 26A.

In this embodiment, the two surfaces of the sheet forming the packaging are adapted so that the adhesion of the adhesive 44 is greater on the surface forming the inside of the packaging than on the surface forming the outside. Thus, the adhesion of the adhesive 44 on the strip 43B is greater than the adhesion of the adhesive on the outer surface of the section 26A.

Whatever the embodiment described here, it is understood that the packaging can be reliably resealed, it not being possible for the roll formed from the neck to unroll itself. Furthermore, the resealing of the packaging is guaranteed by a very low cost means, it being possible for this means to be manufactured simultaneously with the pouch packaging the products. Finally, putting the means retaining the roll in place is relatively easy for the user.

The invention claimed is:

1. A flexible packaging (10) comprising a body (22) initially closed at one end in a region intended to be open, the body (22) comprising at least one main face (26) formed from two sections (26A, 26B) whose longitudinal edges are bonded to each other along a longitudinal weld (14) lying along the height of the body (22) substantially in the central part of the main face (26), at least one of the sections (26A, 26B) extending outside the body beyond the longitudinal weld (14) in order to form a flap (36), characterized in that it comprises a line of weakness (42) which favors tearing and which is formed on the flap (36) along the longitudinal weld (14), the said line of weakness (42) defining, on the flap (36), at least one strip (43A; 43B) which can be detached at least locally from the body (22) of the packaging and an adhesive (44; 46) borne by a strip (43A; 43B), which adhesive (44; 46) is suitable for providing subsequent sticking of the strip against the outer surface of the packaging.

2. The packaging as claimed in claim 1, characterized in that the flap (36) comprises, in the region bearing the adhesive (44, 46), superimposed extensions (38A, 38B) of the two sections (26A, 26B).

3. The packaging as claimed in claim 1, characterized in that the flap (36) comprises, in the region bearing the adhesive (44, 46), only one (38B) of the extensions of the two sections (26A, 26B).

4. The packaging as claimed in claim 3, characterized in that the longitudinal weld (14) is of an outer face against inner face type.

5. The packaging as claimed in claim 1, characterized in that the longitudinal weld (14) is of an inner face against inner face type.

6. The packaging as claimed in claim 1, characterized in that the adhesive (44; 46) is placed along one face of a strip (43A; 43B) turned toward the body (22) of the packaging.

7. The packaging as claimed in claim 1, characterized in that the adhesive (44; 46) is a pressure-sensitive adhesive, which adhesive is initially inserted between a strip (43A; 43B) and the outer surface of one (26A) of the packaging sections, the adhesion force of the adhesive to the surface of the strip (43A; 43B) being greater than the adhesion force of the adhesive to the outer surface of the section (26A).

8. The packaging as claimed in claim 1, characterized in that it comprises a detachable protective film (48) initially covering the adhesive (46) borne by the strip.

9. The packaging as claimed in claim 1, characterized in that the adhesive is an adhesive chosen from the group consisting of a hotmelt, a cold-setting adhesive, a double-sided adhesive tape and an adhesive bead.

* * * * *